United States Patent [19]

Doyle, Jr.

[11] Patent Number: 4,467,960

[45] Date of Patent: Aug. 28, 1984

[54] COMBINATION WEATHERVANE HEAT EXCHANGER

[76] Inventor: Howard E. Doyle, Jr., P.O. Box 821, Chicopee, Mass. 01014

[21] Appl. No.: 561,305

[22] Filed: Dec. 14, 1983

[51] Int. Cl.[3] ..... F24B 7/00

[52] U.S. Cl. ..... 237/55; 98/46; 98/68; 165/DIG. 2

[58] Field of Search ..... 165/DIG. 2, 47; 237/46, 237/55; 98/61, 65, 68, 46

[56] References Cited

U.S. PATENT DOCUMENTS

| | | | |
|---|---|---|---|
| 4392 | 3/1846 | Chase | 98/63 |
| 209,072 | 10/1878 | Owens | 98/61 |
| 680,865 | 8/1901 | Jordan | 98/65 |
| 1,167,120 | 1/1916 | Schmelz | 98/61 |
| 1,454,752 | 5/1923 | McCullough | 98/68 |
| 2,619,022 | 11/1952 | Hergenrother | 237/55 X |
| 2,764,972 | 10/1956 | Ryder | 237/55 X |
| 2,877,834 | 3/1959 | Campbell | 98/46 X |

*Primary Examiner*—William E. Tapolcai
*Attorney, Agent, or Firm*—Fishman & Dionne

[57] ABSTRACT

A heat retrieving device is disclosed which directs cool incoming fresh air down a duct within a flue pipe. Hot gasses in the flue pipe heat the incoming air, warming it sufficiently so that it can be discharged directly into a room that is to be heated, thus supplementing the existing heating system. In the preferred embodiment, the upper exterior portion of the exhaust flue is an inverted L-shape that is mounted on a rotatable bearing. A weathervane having an air scoop on one end and both a main vane and a pilot vane on the other end is securely mounted in the horizontal portion of the flue pipe, causing it to rotate into the wind. The upper portion of the duct within the flue pipe is also bearing-mounted and terminates into the fresh air scoop which exits from the flue pipe. Said air scoop is preferably located directly below the air scoop of the weathervane. As the air scoop of the weathervane turns into the wind, the air scoop of the fresh air intake duct also turns into the wind. The pressure from the wind forces cool air into the interior duct wherein it flows downward and is heated by rising exhaust gasses in the flue pipe. At the base of the flue pipe, the interior fresh air duct terminates in a vent which permits the now heated fresh air to be discharged into the structure to be heated. A suitable thermostatic device will be installed prior to the fresh air vent.

5 Claims, 6 Drawing Figures

Fig. 1.
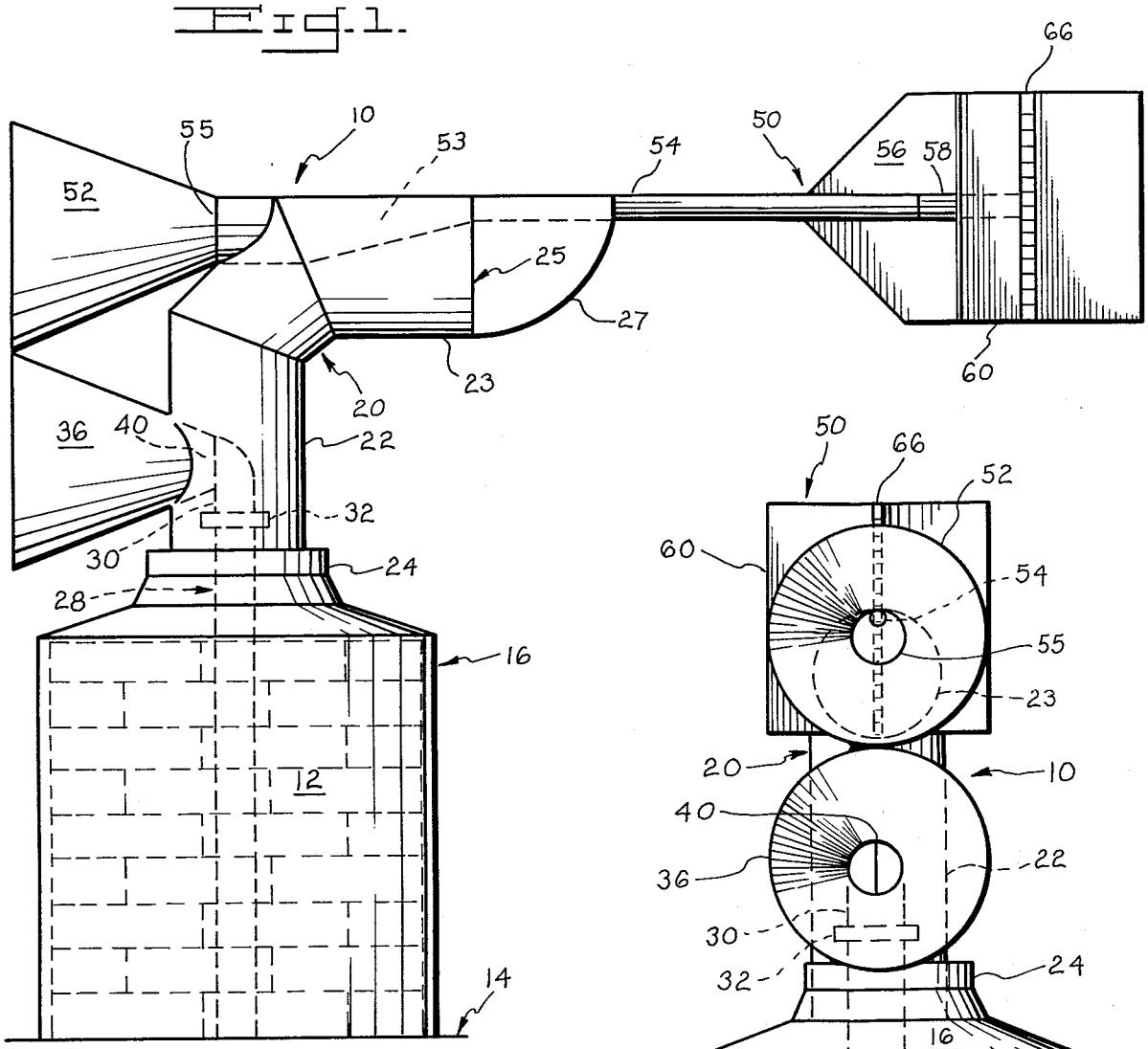
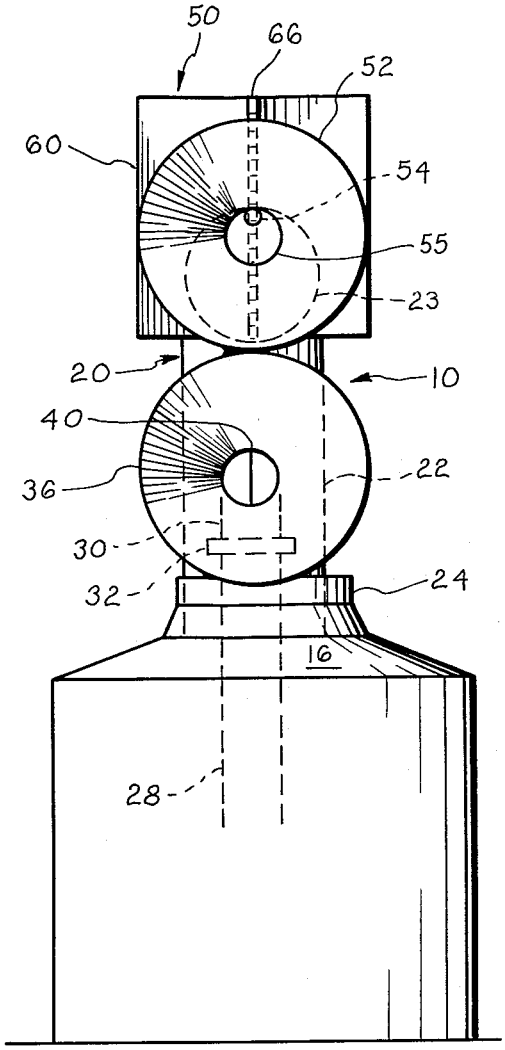
Fig. 2.

COMBINATION WEATHERVANE HEAT EXCHANGER

BACKGROUND OF THE INVENTION

This application is a substitute application for U.S. patent application Ser. No. 249,083, filed Mar. 30, 1981, which was abandoned before the filing of this application. The device of this application was first described in Disclosure Document No. 067347 filed Jan. 9, 1978 and was described a second time in Disclosure Document No. 068473 filed Feb. 13, 1978.

(1) Field of the Invention

This invention pertains to heat exchangers generally and specifically to a heat retrieving device in which a rotatable fresh air intake pipe is positioned within a hot flue gas exhaust pipe to heat the incoming fresh air to be directed downward through the interior pipe. Air scoops are used on bearing-mounted pipe sections to direct the weathervane and fresh air intake into the wind.

(2) Description of the Prior Art

The use of a pipe within a flue pipe for heating or preheating air to retrieve some of the heat usually escaping through the flue pipe of a stove or furnace is well known in the prior art. Many devices, both simple and complex, have been devised for this purpose. Some are simple recirculation devices and fail to provide additional fresh air. The provision of additional fresh air is a desirable feature to replenish the supply of oxygen within the heated structure. Also, the introduction of fresh, preheated air containing oxygen will improve the combustion in the furnace or fireplace. The device of the present invention is designed to overcome many deficiencies found in the prior art.

U.S. Pat. No. 2,479,413 discloses a flue heat exchanger having a complex pipe within a pipe structure and utilizes a fan for circulation. U.S. Pat. No. 2,916,983 discloses a pipe within a pipe system having a fresh air intake solely for the purpose of cooling hot flue gasses in the flue pipe. U.S. Pat. No. 3,691,930 teaches a wind control flue and air intake assembly to balance the effects of changes in wind velocity and direction for the fresh air intake of a gas furnace installation. No heat exchanger is involved.

U.S. Pat. No. 3,913,663 discloses a circuitous chamber installed within a flue pipe to preheat incoming fresh air. U.S. Pat. No. 4,034,803 teaches another type of heat exchanger for preheating air by flue gasses. U.S. Pat. No. 4,040,477 teaches still another heat exchanger which is complex in structure and which uses flue gasses to heat incoming fresh air for discharge into a room. Blowers are utilized to force the air and hot gasses through the system. U.S. Pat. No. 4,050,628 discloses another type of heat exchanger whereby flue gasses are used to warm incoming fresh air.

All the prior art devices, whether patented or not, are of a complex variety and many require fans to force either fresh air or hot gasses through the heat exchanger unit. The principle objective of the present invention is to provide a fresh air, flue pipe heat exchanger, which will reclaim heat for a substantial length of said flue pipe, by running to its outside portion, without being in danger of sucking in gasses from its exhaust exit.

Because smoke either rises vertically or is blown in the opposite direction of the fresh air scoop, said exhaust exit will always face the opposite direction of the prevailing wind. Thus, the present invention will prevent down drafts.

Also, the present invention takes advantage of wind pressure to force cold air down the fresh air duct. Since the fresh hot air vent can easily be adapted to utilize the draft created by the furnace fan or blower, the present invention may not require any additional source of power to operate. However, this arrangement may prove unfeasible in some heating systems, so a fan or blower device at the fresh hot air intake vent will be optional.

SUMMARY OF THE INVENTION

This invention pertains to a heat retrieving device whereby a weathervane mounted on a rotatable flue pipe turns the flue pipe away from the wind and a rotatable fresh air intake pipe into the wind. Air scooped into the fresh air intake pipe under wind pressure is forced down a pipe within the flue pipe, whereby it is heated by rising gasses in the flue pipe and discharged into the heating system of the structure being heated.

In the present invention, a flue pipe rises vertically from the combustion chamber of the heating system a finite distance above the roof line of the structure being heated. For purposes of the present invention, that portion of the flue pipe which is above the roof line of the structure is preferably formed into an inverted L-shape, having a vertical leg and an upper horizontal leg, the hot gasses from the flue pipe being discharged from the end of the horizontal leg. The inverted L-shaped portion of the flue pipe is rotatably mounted to the lower segments of the flue pipe by a ball-bearing mount which is airtight so that no gasses may escape through this juncture. A fresh air intake pipe, having an inverted upper segment of narrower diameter than the flue pipe, is installed within the flue pipe such that its upper segment joins with the fresh air scoop which extends outwardly from the flue pipe just below the horizontal leg of the flue pipe, the exit joint being tightly sealed to prevent flue gasses from entering the fresh air intake pipe. The fresh air intake is positioned 180 degrees from the exhaust end of the horizontal leg of the flue pipe. The upper segment of the intake pipe is also rotatably secured to its lower portion by a ball-bearing mount within the flue pipe. The fresh air intake pipe then continues vertically downward through the flue pipe to a point just above the combustion chamber. At this point, the vertical intake pipe is journalled in an L-shaped lower segment which has a base leg that exits from the flue pipe through an airtight seal to discharge heated fresh air into the structure being heated. Since the rotatable upper, inverted L-shaped segments of the flue pipe and the upper segment of the fresh air intake pipe are firmly joined together, they will rotate together.

The upper segments of the flue pipe and the fresh air intake pipe are caused to rotate by a novel weathervane which is secured in the top of the horizontal leg of the flue pipe. This weathervane is comprised of an air scoop, with a butterfly valve, into which enters the horizontal leg of the flue pipe at its windward side. Said air scoop joins with a venturi which travels the length of the horizontal leg and connects to an air pipe. The air pipe is fastened to the main vane and terminates into a right-angle pilot vane at the rear quarter section of the main vane. As the wind velocity approaches a critical level, the air scoop and butterfly valve act as a governor and will increasingly counteract the main vane and turn the air scoops further and further away from the moving air masses. The weathervane is attached to an upper segment of the flue pipe by a horizontal arm in the form of a main vane air pipe.

The weathervane pipe terminates in a section of flexible pipe extending horizontally above and just beyond the exit opening of the flue pipe. The flexible pipe portion of the weathervane terminates in a Y-shaped right angle rudder fastened to the weathervane pipe by a spring tensioned hinge. A pair of vertically oriented trapezoidal shaped fins are provided at the end of the weathervane pipe. A pilot vane is secured behind and beyond the Y-shaped right angle rudder to control the weathervane in high velocity winds. The butterfly valve for the air scoop is positioned within that portion of the weathervane which is above the upper horizontal leg of the flue pipe to prevent freezing of the spring tensioned hinge. As an alternate to the pilot vane, a novel right-angle aileron may be utilized which is held in a closed position by a spring tensioned hinge and pivots open to a 90-degree position under high velocity winds.

The fresh air intake pipe has an air scoop positioned directly below the air scoop for the weathervane. It likewise has a butterfly valve positioned sufficiently within the intake pipe to prevent freezing of its spring tensioned hinge.

The pressure of the wind will act upon the fins of the weathervane to cause the two air scoops to rotate into the direction of the wind. The wind entering the upper air scoop will stabilize the weathervane. The wind entering the lower air scoop will enter under pressure, thus forcing cold air to flow downward through the fresh air duct. As the cold air flows downward it will be heated by the flue gasses rising out of the flue. By the time the fresh air reaches the base of its duct, it will be warm enough to exit into a room to be heated or into the ductwork of a hot air heating system. If the wind velocity should be too great for the system, the butterfly valve in the fresh air scoop will begin to close, diminishing the amount of air in the fresh air duct. When the wind speed is strong enough to force said butterfly valve completely closed, the butterfly valve in the weathervane air scoop will open completely. The resulting air pressure through the vane pipe will force said right angle aileron to deploy, and the moving air mass against said aileron will cause the air scoops to move away from the direct force of the wind, and so stabilize pressure inside the fresh air duct. Pressure operated thermostatic controls will also be utilized, especially to control the flow of cold fresh air down the air intake duct to allow sufficient time for the downward flowing air to warm up and to close the fresh air intake if no hot gasses are present in the flue.

In warmer weather, the fresh air intake may be opened to allow cooler air to flow into the system under wind pressure.

BRIEF DESCRIPTION OF THE DRAWINGS

FIG. 1 is a side view of the combination weathervane heat exchanger of the present invention;

FIG. 2 is a front view of the air scoops of the present invention;

DESCRIPTION OF THE PREFERRED EMBODIMENT

Figure 3:
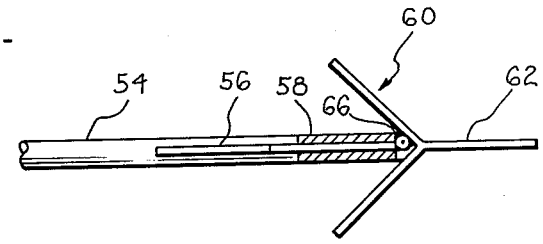
FIG. 3 is a top view of the weathervane of the present invention.

Referring now to the drawings, FIG. 1 is a side view of the combination weathervane heat exchanger of the present invention, designated generally by the reference numeral 10. Device 10 is installed at the upper end of a chimney 12 above the roof line 14 and the juncture is protected by a metal cap 16. Sheet metal cap 16 also serves to trap warm flue gasses for a time to further heat the air in the fresh air duct described hereinafter. Said metal cap 16 fits over the chimney 12 and is substantially square-shaped. Its dual purpose is to support apparatus 10 and to protect chimney 12 from the elements. It can also serve as an alternate or replacement chimney. Apparatus 10 has an upper segment 20 of a generally inverted L-shape, the base of its vertical leg 22 being rotatably mounted to the chimney cap 16 by a ball-bearing housing 24. Upper segment 20 has a horizontal leg 23 which terminates in an opening 25 through which flue gasses escape. Opening 25 is protected from the elements by a hood 27.

A fresh air intake pipe 28 runs vertically downward through chimney 12. The upper segment 30 of fresh air intake pipe 28 also is mounted on a ball-bearing housing 32. The upper segment 30 terminates in a conical shaped air scoop 36 which extends slightly into flue pipe upper segment 22. The juncture between flue pipe segment 22 and air scoop 36 is tightly sealed to prevent flue gasses from entering the fresh air intake system. Air scoop 36 is located such that its intake is positioned 180 degrees opposite the exhaust end of upper segment 20.

The wind pressure in fresh air intake scoop 36 is controlled by a butterfly valve 40 to close partially or completely the air scoop 36 in the event of high wind velocity. Since the upper inverted L-shaped segment 20 and the fresh air intake pipe 30 are firmly linked to each other at the juncture of air scoops 36 and 52 and since both are rotatably mounted on ball-bearing housings 24,32 respectively, when one segment rotates the other will also rotate the same degree. The wind pressure in fresh air intake pipe 28 is also controlled by any suitable thermostatic device (not shown).

Figure 4:
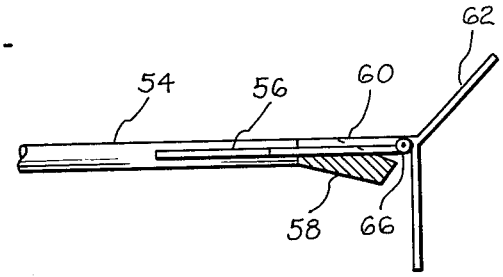
FIG. 4 is a top view of the embodiment of FIG. 3 showing a right angle rudder deployed.
Figure 5:
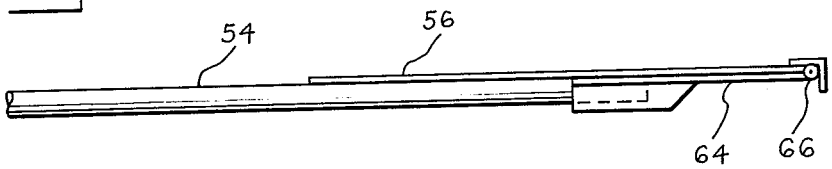
FIG. 5 is a top view of an alternate embodiment of the present invention.
Figure 6:
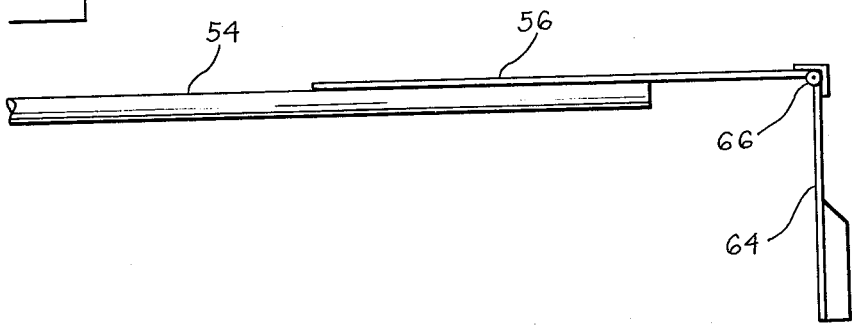
FIG. 6 is a top view of the embodiment of FIG. 5 showing a right angle aileron deployed.

The rotation of segments 20 and 30 is caused by a novel weathervane designated generally by the reference numeral 50. Weathervane 50 is secured rigidly to the horizontal leg 23 of upper segment 20. Weathervane 50 has a conical shaped air scoop 52 positioned directly above (and optionally secured to) air scoop 36 and feeds into the venturi pipe 53 which, in turn, feeds into main vane pipe segment a horizontal support arm 54 (here, an air pipe). Butterfly valve 55 serves as a governor to open or partially open air scoop 52 in the face of shifting winds of high velocity. Trapezoidal shaped fins 56 are appended to the opposite end of main vane pipe segment 54. Main vane pipe segment 54 terminates in a piece of flexible pipe 58. A Y-shaped rudder 60 pivotally connects to the main vane 56 by a spring tensioned hinge 66 serving to limit the rotation of pilot vane 62 in shifting winds of high velocity. Also, Y-shaped rudder 60 serves as a limiting factor since it can only pivot through an arc of 45 degrees in very strong winds (see FIGS. 3, 4). After pivoting in a strong wind, the opposite end of Y-shaped rudder 60 will be at a 90-degree angle in relation to main vane 56.

FIG. 2 is a front view of the weathervane controlled heat exchanger of the present invention showing the relative positions of its various components described in relation to FIG. 1.

SYSTEM OPERATION

As the wind changes direction, weathervane assembly 50 normally causes air scoops 36 and 52 to face into the wind. Fresh wind-blown air enters air scoop 36 and is forced down through fresh air intake pipe 28 running inside chimney 12, where it is heated in its downward travel and exits into the room to be heated or into the ductwork of the heating system.

An air pressure thermostatic (pneumatic) control and a butterfly valve 40 govern the flow of fresh air intake in scoop 36 so that the air will be sufficiently heated by gasses in chimney 12. If no hot gasses are present, the thermostat causes the valve 40 to remain fully closed.

When the moving air mass reaches a critical speed, the pilot vane 62 will force one section of the right angle rudder 60 against the side of main vane 56. This action will cause the flexible pipe segment 58 to move in the direction of the opposite end of rudder 60 which will now be in a 90-degree relation to main vane 56. When the wind pressure in air scoop 36 forces butterfly valve 40 closed, the butterfly valve 55 in the air scoop 52 will open. The resulting air pressure through pipe segment 54 and 58 will blow against the side of right angle rudder 60 to turn the entire apparatus 10 away from the full force of the wind. This arrangement will keep the air flow within apparatus 10 fairly constant.

As explained earlier, right angle aileron 64 may be substituted for pilot vane 62 and will serve the same purpose except that right angle aileron 64 will deploy on only one side of weathervane 50.

While only one embodiment of the present heat recovery apparatus has been described in detail herein, various changes and modifications may be made without departing from the scope of the invention. Accordingly, reference should be made primarily to the appended claims rather than the specification to determine the scope of the invention.

Having thus described the invention, what is claimed is:

1. A heat-recovery apparatus comprising:

(a) an exhaust gas flue pipe having a passage therethrough for connection to a source of hot gasses;

(b) said flue pipe terminating in an inverted, substantially L-shaped end segment, wherein said end segment has a substantially horizontal exhaust leg with an exhaust opening for said flue pipe;

(c) means for rotatably mounting said end segment above the roof line of a structure;

(d) a fresh air intake pipe of smaller diameter than said flue pipe and positioned within said flue pipe;

(e) said fresh air intake pipe having a vertical section and a substantially horizontal section that extends outwardly through said flue pipe and acts as an intake for said fresh air pipe;

(f) means for rotatably supporting the vertical section of said fresh air intake pipe within said flue pipe such that the fresh air intake pipe is rotatable with said flue pipe; and (g) weathervane means to control the rotation of said flue pipe and said fresh air intake pipe in response to wind pressure and direction, such that the intake of said fresh air pipe faces directly into the wind when the wind pressure is below a predetermined value and is turned away from the full face of the wind when the wind exceeds the predetermined value, said weathervane means including a main vane air pipe having one end secured to the horizontal leg of the exhaust flue pipe and an opposite end secured to a vane, and a conical air scoop which extends outwardly through said flue pipe and is connected in fluid communication to said main vane air pipe, whereby air flows through said air scoop and said main vane air pipe and against the vane to cause said fresh air pipe to rotate when the wind pressure exceeds the predetermined value so that the intake of said fresh air pipe is turned away from the full force of the wind.

2. The heat-recovery apparatus of claim 1 wherein the vane is pivotally connected to said main vane air pipe.

3. The heat-recovery apparatus of claim 2 wherein the vane is substantially Y-shaped.

4. The heat-recovery apparatus of claim 2 wherein the vane is a right-angle aileron which is normally biased in a parallel position to said main vane pipe and means to pivot and deploy said aileron substantially perpendicularly to said main vane air pipe when the wind pressure in said main vane air pipe exceeds said predetermined value, which results in turning the intake of said fresh air pipe away from the full force of the wind.

5. The heat-recovery apparatus of claim 1 wherein the apparatus includes valve means to regulate the amount of air intake in said air intake pipe, said valve means including a butterfly valve mounted in said intake pipe wherein the valve opens and closes in response to the presence of shifting winds.

* * * * *